US011448236B2

(12) United States Patent
Klumpp et al.

(10) Patent No.: US 11,448,236 B2
(45) Date of Patent: Sep. 20, 2022

(54) OUTLET GUIDE VANE

(71) Applicant: Siemens Energy Global GmbH & Co. KG, Bayern (DE)

(72) Inventors: Stephan Klumpp, Mettmann (DE); Britta Puyn, Düsseldorf (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/261,000

(22) PCT Filed: Aug. 6, 2019

(86) PCT No.: PCT/EP2019/071068
§ 371 (c)(1),
(2) Date: Jan. 16, 2021

(87) PCT Pub. No.: WO2020/035348
PCT Pub. Date: Feb. 20, 2020

(65) Prior Publication Data

US 2021/0293251 A1 Sep. 23, 2021

(30) Foreign Application Priority Data

Aug. 17, 2018 (EP) ..... 18189468

(51) Int. Cl.
*F04D 29/54* (2006.01)
*F01D 5/14* (2006.01)
(Continued)

(52) U.S. Cl.
CPC ..... *F04D 29/541* (2013.01); *F01D 5/141* (2013.01); *F04D 29/321* (2013.01);
(Continued)

(58) Field of Classification Search
CPC ..... F04D 29/324; F04D 29/544
See application file for complete search history.

(56) References Cited

U.S. PATENT DOCUMENTS 6,508,630 B2 * 1/2003 Liu ..... F04D 29/544 416/243
8,337,154 B2 * 12/2012 Decker ..... F04D 29/384 416/223 R (Continued)

FOREIGN PATENT DOCUMENTS

WO WO-2005040559 A1 * 5/2005 ..... F01D 5/146
WO 2008109036 A1 9/2008

OTHER PUBLICATIONS

PCT International Search Report and Written Opinion of International Searching Authority dated Nov. 28, 2019 corresponding to PCT International Application No. PCT/EP2019/071068 filed Aug. 6, 2019.

*Primary Examiner* — Ninh H. Nguyen
*Assistant Examiner* — John S Hunter, Jr.
(74) *Attorney, Agent, or Firm* — Wolter Van Dyke Davis, PLLC

(57) ABSTRACT

An outlet guide vane for an axial compressor extending along a rotor axis, includes an airfoil extending in a span direction from a radially inner end at 0% height to a radially outer end at 0% height. The airfoil has a suction side and an opposite pressure side, both sides extending in a chord direction from a leading edge to a trailing edge, wherein for each profile of the airfoil a stagger angle between the chord and the rotor axis is defined. A more favorable air flow profile behind the outlet guide vane is achieved by a new shape of the outlet guide vane, wherein a stagger angle distribution in the span direction has a curved course having a minimum located between 40% and 60% in the span direction, a first maximum at 0% and a second maximum at 100% in the span direction.

7 Claims, 3 Drawing Sheets

(51) Int. Cl.
*F04D 29/32* (2006.01)
*F04D 29/38* (2006.01)

(52) U.S. Cl.
CPC ..... *F04D 29/324* (2013.01); *F04D 29/384* (2013.01); *F04D 29/544* (2013.01); *F05D 2240/12* (2013.01)

(56) References Cited

U.S. PATENT DOCUMENTS

| | | | |
|---|---|---|---|
| 2002/0141863 | A1 | 10/2002 | Liu |
| 2007/0231149 | A1 | 10/2007 | Aynes |
| 2008/0226454 | A1 | 9/2008 | Decker |

* cited by examiner

OUTLET GUIDE VANE

CROSS REFERENCE TO RELATED APPLICATIONS

This application is the US National Stage of International Application No. PCT/EP2019/071068 filed 6 Aug. 2019, and claims the benefit thereof. The International Application claims the benefit of European Application No. EP18189468 filed 17 Aug. 2018. All of the applications are incorporated by reference herein in their entirety.

FIELD OF INVENTION

The invention relates to an outlet guide vane for an axial compressor extending along a rotor axis, comprising an airfoil extending in a span direction from a radially inner end at 0% height to a radially outer end at 100% height, the airfoil comprising a suction side and an opposite pressure side, both sides extending in a chord direction from a leading edge to a trailing edge, wherein for each profile of the airfoil a stagger angle between the chord and the rotor axis is defined. The invention further relates to an axial compressor having a plurality of outlet guide vanes.

BACKGROUND OF INVENTION

A conventional gas turbine engine includes in serial flow communication an axial compressor, a discharge flow path having a stage of compressor outlet guide vanes (OGVs), disposed between annular inner and outer walls, which in turn are mounted in an outlet guide vane support structure mechanically tied into an engine casing. Outlet guide vanes typically have airfoil like cross-sections that include a leading edge, a relatively thick middle section, and a thin trailing edge. If the compressor is part of a gas turbine, downstream of the outlet guide vane stage is a combustor diffuser, a combustor, a turbine nozzle and a turbine. The outlet guide vanes stage is usually provided after all other compressors stages in order to straighten the flow from the compressor and direct it appropriately to the combustor.

During engine operation, the compressor compresses inlet airflow, which is therefore heated thereby. The discharged compressed and heated airflow is then channeled through the outlet guide vanes and the diffuser to the combustor. In the combustor it is mixed with fuel and ignited to form combustion gases. The combustion gases are channeled through the turbine nozzle to the e.g. high pressure turbine which extracts energy therefrom for rotating and powering the compressor.

The compressor diffuser of a gas turbine converts dynamic pressure into static pressure. The more dynamic pressure is converted, the better the efficiency of the compressor and thus of the gas turbine. The conversion from dynamic to static pressure is done by decelerating the flow.

The velocity profile of the flow is of great importance for improving the deceleration in the diffuser of an axial compressor. If the air flows through the diffuser at the same average velocity in a uniform block profile, it contains less kinetic energy than in a profile with a distinct "velocity peak". A uniform velocity profile results in a lower compressor outlet total pressure at a certain static pressure, i. e. with less energy input, which has a positive effect on the efficiency of the gas turbine engine.

However, due to the previous compressor stages and the wall friction within the compressor, the flow at the diffuser inlet generally has an unfavorable velocity profile.

US 2007/231149 A1 discloses a guide vane having a particular design, due to which design the static stress in the brazed joint formed between the vane and the outer shroud is decreased.

SUMMARY OF INVENTION

Therefore, an object of the present invention is to provide a more favorable air flow profile at the outlet of the compressor.

The object of the invention is achieved by the independent claims. The dependent claims describe advantageous developments and modifications of the invention.

In accordance with the invention there is provided an outlet guide vane for an axial compressor extending along a rotor axis, comprising an airfoil extending in a span direction from a radially inner end at 0% height to a radially outer end at 100% height, the airfoil comprising a suction side and an opposite pressure side, both sides extending in a chord direction from a leading edge to a trailing edge, wherein for each profile of the airfoil a stagger angle between the chord and the rotor axis is defined, wherein a stagger angle distribution in the span direction has a curved course having a minimum located between 40% and 60% in the span direction, a first maximum at 0% and a second maximum at 100% in the span direction.

In accordance with the invention there is also provided an axial compressor having a plurality of such outlet guide vanes.

The present invention is based on the idea to use a new three-dimensional design of the outlet guide vane in order to enhance the vortices in the secondary flow which cause an exchange of momentum within the flow and thus generate a smoother velocity profile at the diffuser outlet. Due to the proposed new geometry of the outlet guide vane a radial rearrangement of the velocity profile to the side walls in the direction of the suction side is achieved and a "block-shaped" velocity profile is generated.

In the past, the outlet guide vane has been designed so that the flow into the diffuser is free of swirls. Vortices in the secondary flow were either neglected or considered undesirable. In the present invention, the outlet guide vane is specifically designed so that strong vortices occur. These vortices are oriented approximately in the direction of the rotor axis. Important for the function of these vortices is their significant expansion in the span direction, i.e. the vortices have to be as large as possible in order to transport the flow in the direction of the walls.

In an embodiment, the difference in the stagger angle between the minimum and the first maximum is between 8° and 23°. In an embodiment, the difference in the stagger angle between the minimum and the second maximum is between 6° and 22°. Such design of the outlet guide vane benefits the occurrence and spread of the block-shaped velocity profile.

In another embodiment, the longest chord length is at the outer end.

In yet another embodiment, the stagger angle in the minimum is between 1° and 7°.

Preferably, the stagger angle at the first maximum is between 14° and 26°.

Still further, the stagger angle at the second maximum is between 8° and 28°.

BRIEF DESCRIPTION OF THE DRAWINGS

Embodiments of the invention are now described, by way of example only, with reference to the accompanying drawings, of which.

DETAILED DESCRIPTION OF INVENTION

It is noted that in different figures, similar or identical elements are provided with the same reference signs.

Figure 1:
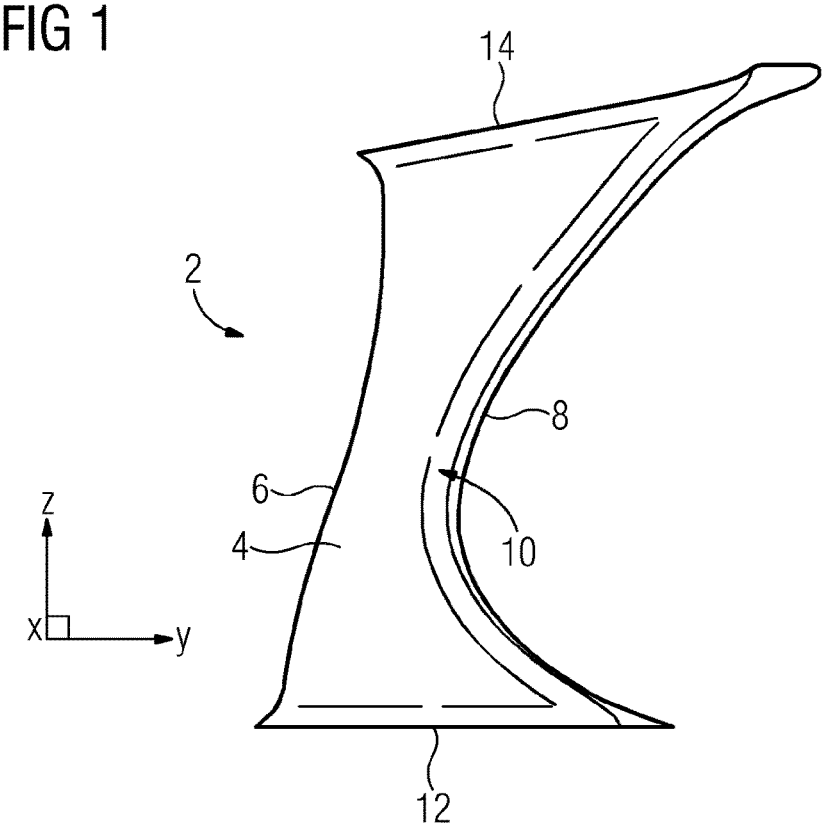
FIG. 1 shows in a perspective view a pressure side an outlet guide vane according to the present invention.
Figure 2:
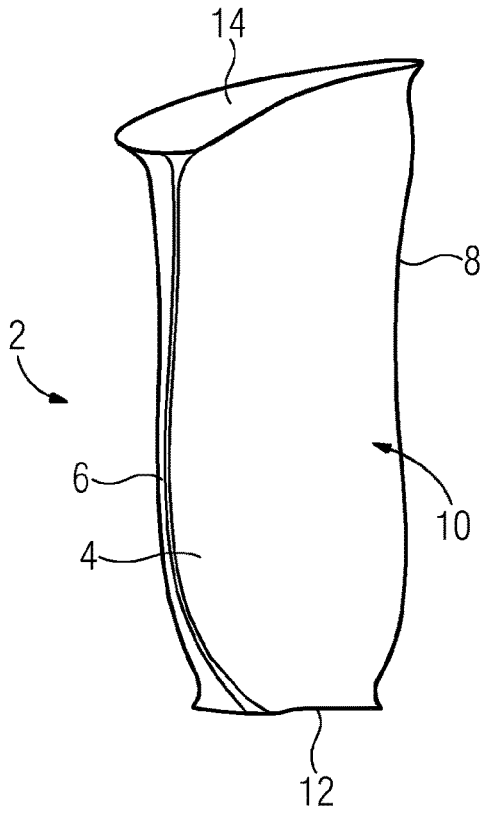
FIG. 2 shows in different perspective view the pressure side the outlet guide vane according to FIG. 1.

FIG. 1 and FIG. 2 show an outlet guide vane 2 for an axial compressor which is not shown in detail. The axial compressor is e.g. an industrial gas compressor or is part of a gas turbine engine and is operated under subsonic conditions. The axial compressor comprises at its rear end a ring having a plurality of such outlet guide vanes 2. The axial compressor extends in the direction of rotor axis, which in FIG. 1 is parallel to the x-axis.

The outlet guide vane 2 comprises an airfoil 4 having an upstream-sided leading edge 6 and a downstream-sided trailing edge 8 between which a suction side (not shown) and a pressure side 10 extend in chord direction. The radial height of the airfoil 4 is determined from its radially inner end 12 with 0% height to its radially outer end 14 with 100% height. The span direction of the airfoil 4, which is also equivalent to the radial direction of the compressor, is in FIG. 1 parallel to the z-axis.

Figure 3:
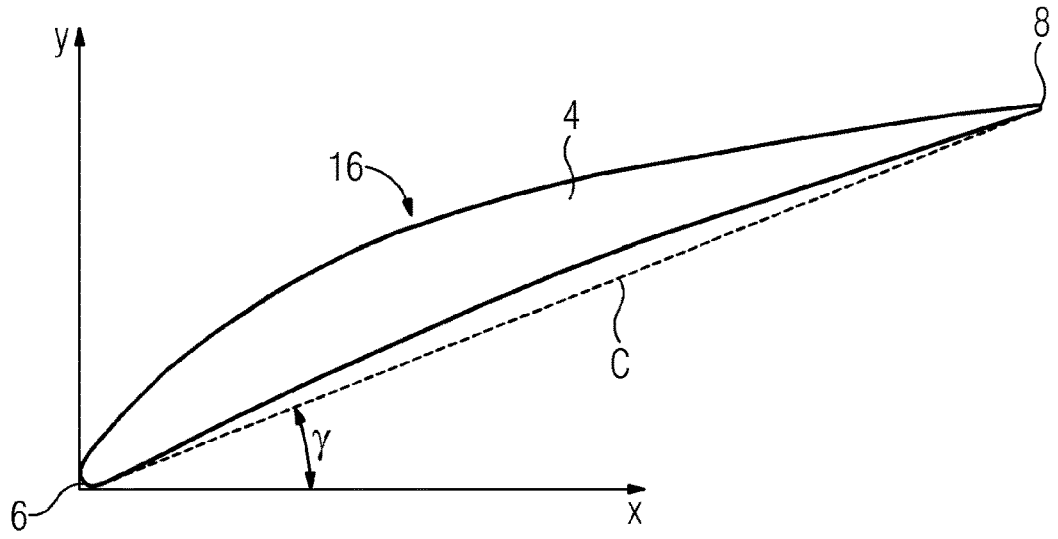
FIG. 3 shows a profile of an outlet guide vane.

For each height position of the airfoil 4, following the fluid streamlines, a profile can be determined. One such exemplary profile 16 is shown in FIG. 3. The profile 16 represents the outer airfoil shape for a specific height of the airfoil 4 defined by a cross section, in particular parallel to the x-y plane through said airfoil 4 at said height rotor axis. For each profile a stagger angle γ is determinable between a chord line C of the profile and the rotor axis x. Hereby the chord line C is an imaginary straight line joining the leading edge 6 and trailing edge 8 of the airfoil 4.

As can be seen in FIG. 1 and FIG. 2, the longest chord length for the airfoil 4 is at the radially outer end 14.

Figure 4:
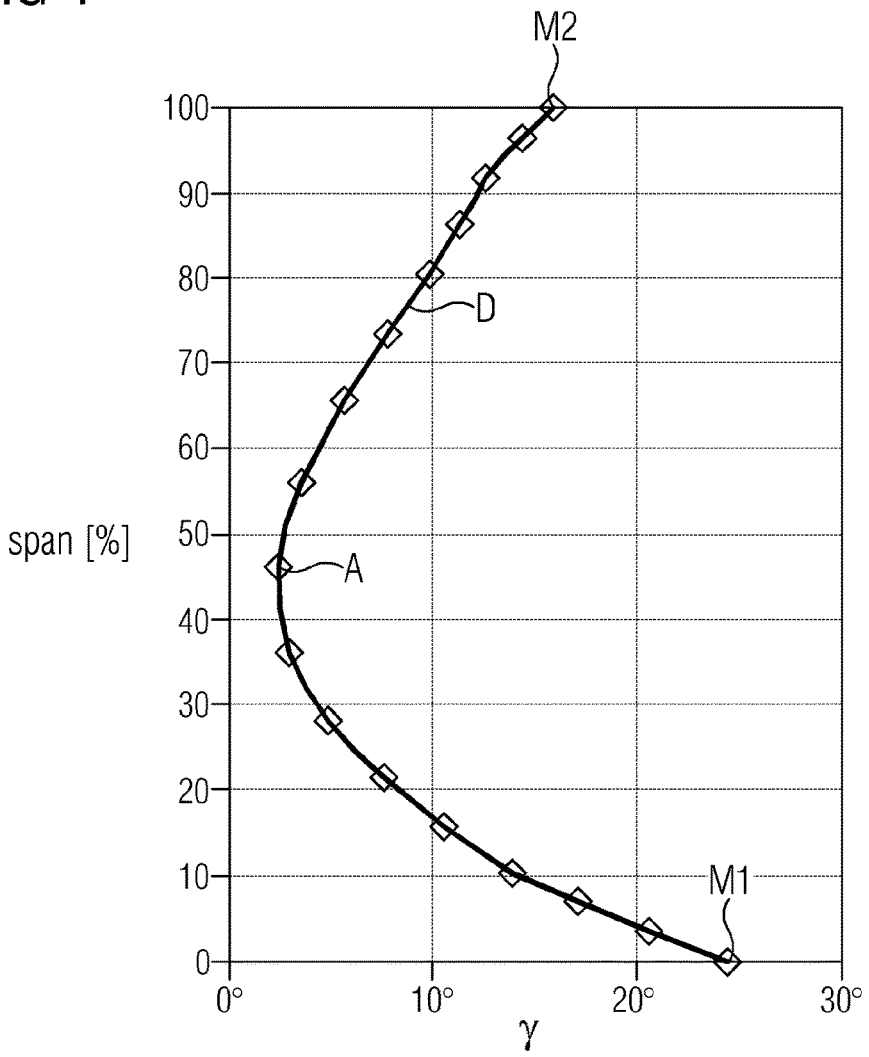
FIG. 4 shows the stagger angle distribution in the span direction for the outlet guide vane shown in FIG. 1.

FIG. 4 shows the distribution of the stagger angle γ in the span direction z from the radially inner end 12 at 0% height to the radially outer end 14 at 100% height. The distribution line D has a curved, u-shaped course having its minimum A located between 40% and 60% in the span direction z. A first maximum $M_1$ of the u-shaped line D is at the radially inner end 12, i.e. at 0% height, and a second maximum $M_2$ is at the radially outer end 14, i.e. at 100% height.

In FIG. 4 the stagger angle γ in the minimum A is approximately 3°. In general, the stagger angle γ at this point is between 1 and 7. The stagger angle γ at the first maximum $M_1$ (at the radially inner end 12, 0% in span direction) is approximately 24° and the stagger angle γ at the second maximum $M_2$ (at the radially outer end 14, 100% in span direction) is approximately 16°. Hence, the difference in the stagger angle γ between the minimum A and the maximum at the radially inner end is 21° and the difference in the stagger angle γ between the minimum A and the maximum at the radially outer end is 13°. In the embodiment shown in FIG. 4 also the stagger angle γ in the second maximum $M_2$ is smaller than the stagger angle γ in the first maximum $M_1$.

Figure 5:
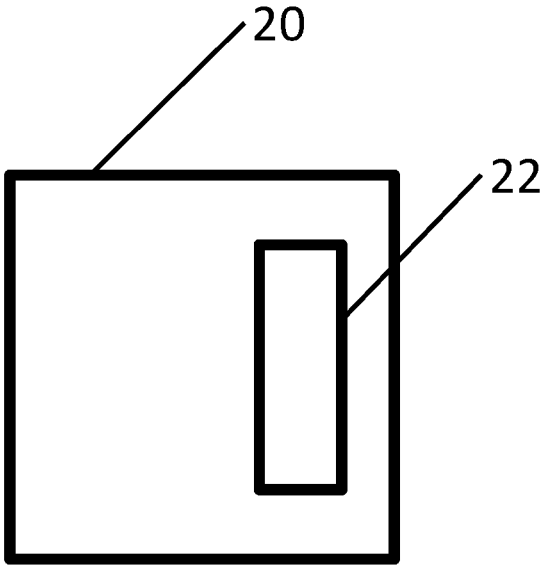
FIG. 5 schematically represents an axial compressor having a plurality of outlet guide vanes according to FIG. 1.

FIG. 5 schematically represents an axial compressor 20 having a plurality of outlet guide vanes 22 according to FIG. 1.

The invention claimed is:

1. An outlet guide vane for an axial compressor extending along a rotor axis, comprising:

an airfoil extending in a span direction from a radially inner end at 0% height to a radially outer end at 100% height, the airfoil comprising a suction side and an opposite pressure side, the suction side and the opposite pressure side extending in a chord direction from a leading edge to a trailing edge, wherein for each profile of the airfoil a stagger angle between the chord and the rotor axis is defined, wherein a distribution of the stagger angles in the span direction comprises a curved course comprising a minimum located between 40% and 60% in the span direction, a first maximum at 0% height and a second maximum at 100% height in the span direction, wherein the stagger angle at the minimum is between 1° and 7°.

2. The outlet guide vane according to claim 1, wherein the difference in the stagger angle between the minimum and the first maximum is between 8° and 23°.

3. The outlet guide vane according to claim 1, wherein the difference in the stagger angle between the minimum and the second maximum is between 6° and 22°.

4. The outlet guide vane according to claim 1, wherein each chord comprises a chord length, and wherein a longest chord length of the chord lengths is at the radially outer end.

5. The outlet guide vane according to claim 1, wherein the stagger angle at the first maximum is between 14° and 26°.

6. The outlet guide vane according claim 1, wherein the stagger angle at the second maximum is between 8° and 28°.

7. An axial compressor, comprising:

a plurality of outlet guide vanes according to claim 1.

* * * * *